US008870597B2

(12) United States Patent
Kawakami

(10) Patent No.: US 8,870,597 B2
(45) Date of Patent: Oct. 28, 2014

(54) CONNECTOR

(71) Applicant: Hosiden Corporation, Yao (JP)

(72) Inventor: Yuta Kawakami, Yao (JP)

(73) Assignee: Hosiden Corporation, Osaka (JP)

( * ) Notice: Subject to any disclaimer, the term of this patent is extended or adjusted under 35 U.S.C. 154(b) by 86 days.

(21) Appl. No.: 13/761,492

(22) Filed: Feb. 7, 2013

(65) Prior Publication Data

US 2014/0051290 A1 Feb. 20, 2014

(30) Foreign Application Priority Data

Feb. 15, 2012 (JP) ..... 2012-030736

(51) Int. Cl.
*H01R 13/648* (2006.01)

(52) U.S. Cl.
USPC ..... 439/607.41; 439/98; 439/108

(58) Field of Classification Search
USPC ..... 439/607.41–607.43, 98, 108
See application file for complete search history.

(56) References Cited

U.S. PATENT DOCUMENTS

| | | | | |
|---|---|---|---|---|
| 6,764,342 | B2 * | 7/2004 | Murayama et al. | 439/607.1 |
| 7,597,563 | B2 * | 10/2009 | Shinkawa et al. | 439/98 |
| 2004/0266266 | A1 | 12/2004 | Lai | |
| 2007/0072457 | A1 * | 3/2007 | Hamazaki | 439/108 |
| 2008/0050951 | A1 * | 2/2008 | Wu | 439/108 |
| 2009/0011624 | A1 | 1/2009 | Yamazaki | |
| 2010/0210124 | A1 | 8/2010 | Li | |
| 2011/0034083 | A1 | 2/2011 | Ko et al. | |
| 2011/0124238 | A1 | 5/2011 | Zhou et al. | |
| 2013/0130521 | A1 * | 5/2013 | Chung et al. | 439/108 |

FOREIGN PATENT DOCUMENTS

| | | | |
|---|---|---|---|
| EP | 1876675 | A1 | 1/2008 |
| JP | 200884799 | A | 4/2008 |

* cited by examiner

*Primary Examiner* — Gary Paumen
(74) *Attorney, Agent, or Firm* — The Webb Law Firm

(57) ABSTRACT

A connector includes a plurality of first contacts and a plurality of second contacts. Each first contact includes a first movable contact portion and a wire connecting portion having a greater width than the width of the first movable portion and connected to a wire. Each second contact is shorter than the first contact and includes a second movable contact portion and a ground contact portion which is not in direct contact with the wire. A contact accommodating member accommodates the first contacts and the second contacts in juxtaposition with each other in such a manner that the wire-side ends of the second contacts are positioned closer to an inserted portion than the wire connecting portions of the first contacts. A guide member includes a ground terminal which comes into contact with the ground contact portion of the second contact.

4 Claims, 7 Drawing Sheets

CONNECTOR

BACKGROUND OF THE INVENTION

1. Field of the Invention

The present invention relates to a connector for connecting a cable having a plurality of wires to a connection target.

2. Description of the Related Art

A connector for connecting a cable having a plurality of wires to a connection target accommodates therein terminal plates (contacts) corresponding to the wires. The wires and the contacts can be connected to each other by soldering, IDC (Insulation Displacement Contact), etc.

In the case of IDC, the end of a contact to be connected to a wire is formed in U-shape having a recess for clamping the wire therein. For this reason, the U-shaped end of the contact has a width greater than the thickness of the wire. Accordingly, when a plurality of contacts are to be arranged in such a manner that the U-shaped ends thereof are disposed in a row, the width of the connector will become greater than the thickness of the cable disadvantageously.

In an attempt to solve the above-described inconvenience, according to a connector disclosed in the Japanese Unexamined Patent Application Publication No. 2008-084799, at one end of the contact, there is formed a terminal portion to be connected to the connection target, whereas at the other end of the contact, there is formed a wire connecting portion to be connected to the wire. Further, the layout of the plurality of contacts is designed such that the terminal portions are disposed in a row whereas the wire connecting portions are disposed in a plurality of rows, with the disposing positions of the plurality of rows corresponding to a plurality of positions along the connecting direction of the connector.

In the case of the connector disclosed in the Japanese Unexamined Patent Application Publication No. 2008-084799, with the above-described configuration of the connector, the number of the wire connecting portions to be disposed in each row is reduced, so that even when the distance between adjacent terminal portions is set small, a sufficient space can be ensured for adjacent wire connecting portions disposed in the same row. Further, as the disposing positions of the plurality of rows are designed to correspond to a plurality of positions along the connecting direction of the connector, sufficient space is ensured for each row. With these, there is realized a connector which is compact and easy to assemble, while ensuring enough space for the connection between the wire connecting portions and the wires.

Further, reduction of the width of the connector is possible also by eliminating a contact(s) other than the contacts required for signal transmission from the connector.

However, in the case of the above-described layout of the contacts in the connector disclosed in the Japanese Unexamined Patent Application Publication No. 2008-084799, there is the risk of deterioration in the transmission performance such as an intra pair skew, a differential impedance, etc. Further, in the case of the arrangement eliminating a contact(s) other than those required for signal transmission from the connector, there is the risk of deterioration in the transmission performance such as a crosstalk, etc.

The present invention has been made in view of the above-described state of the art and its object is to provide a connector which is compact and easy to assemble, but provides superior transmission performance.

SUMMARY OF THE INVENTION

According to one preferred embodiment of the present invention, there is proposed a connector for connecting a cable having a plurality of wires to a connection target, the connector comprising:

a case formed of an insulator;

a plug portion having an inserted portion to be inserted to a jack of the connection target and accommodated in the case such that the inserted portion projects from the case; and a guide member accommodated in the case and formed of an insulator for guiding the plurality of wires to the plug portion;

wherein the plug portion includes a shell formed of a conductor which forms the inserted portion, a plurality of first contacts, a plurality of second contacts, and a contact accommodating member formed of an insulator;

each of the plurality of first contacts includes a first movable contact portion and a wire connecting portion;

the first movable contact portion is placed into elastic contact with a signal contact of the jack when the inserted portion is inserted to the jack, thereby to establish electric connection with the signal contact;

the wire connecting portion has a greater width than the width of the first movable contact portion and is connected with the wire;

each of the plurality of second contacts has a length shorter than the length of the first contact and includes a second movable contact portion and a ground contact portion;

the second movable contact portion comes into elastic contact with a ground contact of the jack when the inserted portion is inserted into the jack, thus being electrically connected with the ground contact;

the ground contact portion is not directly connected to the wire, the contact accommodating member accommodates the first contacts and the second contacts in juxtaposition with each other in such a manner that the wire-side ends of the second contacts are positioned closer to the inserted portion than the wire connecting portions of the first contacts; and the guide member includes a ground terminal which comes into contact with the ground contact portion of the second contact.

In general, a portion which comes into contact with a wire is formed wider than a portion which comes into contact with a contact of the jack. For this reason, when the first contacts and the second contacts are disposed in juxtaposition in alignment with the terminal portions, in particular, the ends on the side to be connected to the wires of the cable, the width of the side to be connected to the wires of the cable is formed greater than the width of the inserted portion. Therefore, the connector per se becomes larger disadvantageously. In view of this, in the case of the above-described inventive arrangement, in disposing the first contacts and the second contacts in juxtaposition, the wire-side ends of the second contacts are positioned closer to the inserted portion than the wire connecting portions of the first contacts. With this, it becomes possible to avoid juxtaposition of the wider portions of the first contacts, i.e. the wire connecting portions of the first contacts and the wire-side ends of the second contacts, so that the end of the connector to be connected to the cable can be formed narrower.

Further, although the ground contact portion of the second contact is not directly connected to the wire of the cable, this ground contact portion is contacted and electrically connected to the ground terminal accommodated in the guide member formed of insulator. Therefore, the potential of the second contact is set to the ground potential. As a result, it is possible to avoid deterioration in the crosstalk performance of the connector.

According to one preferred embodiment of the connector of the present invention, the ground terminal includes a third movable contact portion which comes into elastic contact with the ground contact portion of the second contact. With this arrangement, as the ground terminal comes into elastic contact with the ground contact portion of the second contact, these members can be brought into contact with each other in an easy and reliable manner. This will be advantageous for alleviating the burden on the worker, particularly when the worker assembles the connector on site, i.e. at the work site, for example. The arrangement is advantageous also for allowing appropriate maintenance of the connector quality to such a degree as not relies on the skill of the worker.

According to another preferred embodiment of the connector of the present invention, the connector further comprises:

a cover member formed of a conductor;

wherein the cable includes a ground wire; and the cover member is accommodated in the case and includes a ground wire connecting portion to be electrically connected to the ground wire and a ground terminal connecting portion to be electrically connected to the ground terminal.

With the above-described arrangement, via the cover member and the ground terminal, the ground wire of the wire and the second contact are electrically connected to each other. Therefore, the second contact and the cover member are placed under the same potential (ground potential), so that the EMI (electromagnetic interference) performance and the transmission performance of the connector can be improved. Advantageously, the shell may include a cover connecting portion to be connected to the cover member. With this, the potential of the shell too may be rendered to the ground potential in a reliable manner.

DETAILED DESCRIPTION OF THE PREFERRED EMBODIMENT

Figure 1:
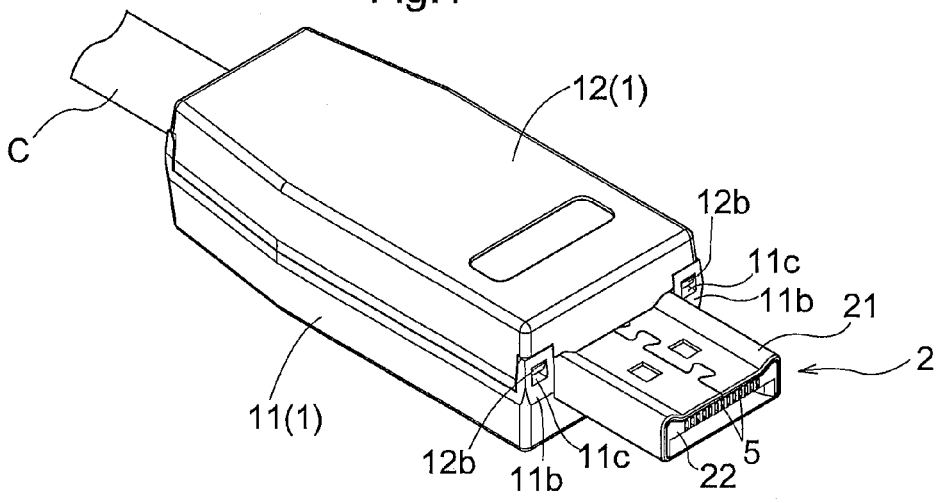
FIG. 1 is a perspective view showing a connector according to the present invention.
Figure 2:
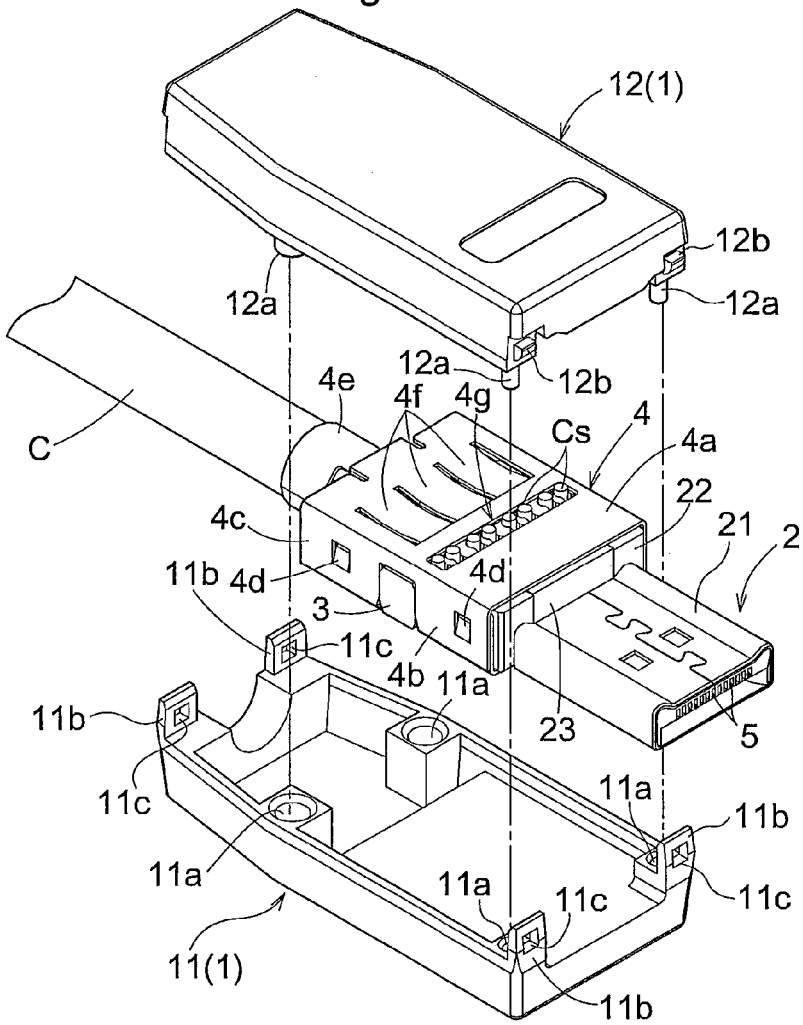
FIG. 2 is an exploded perspective view of the connector according to the present invention.
Figure 3:
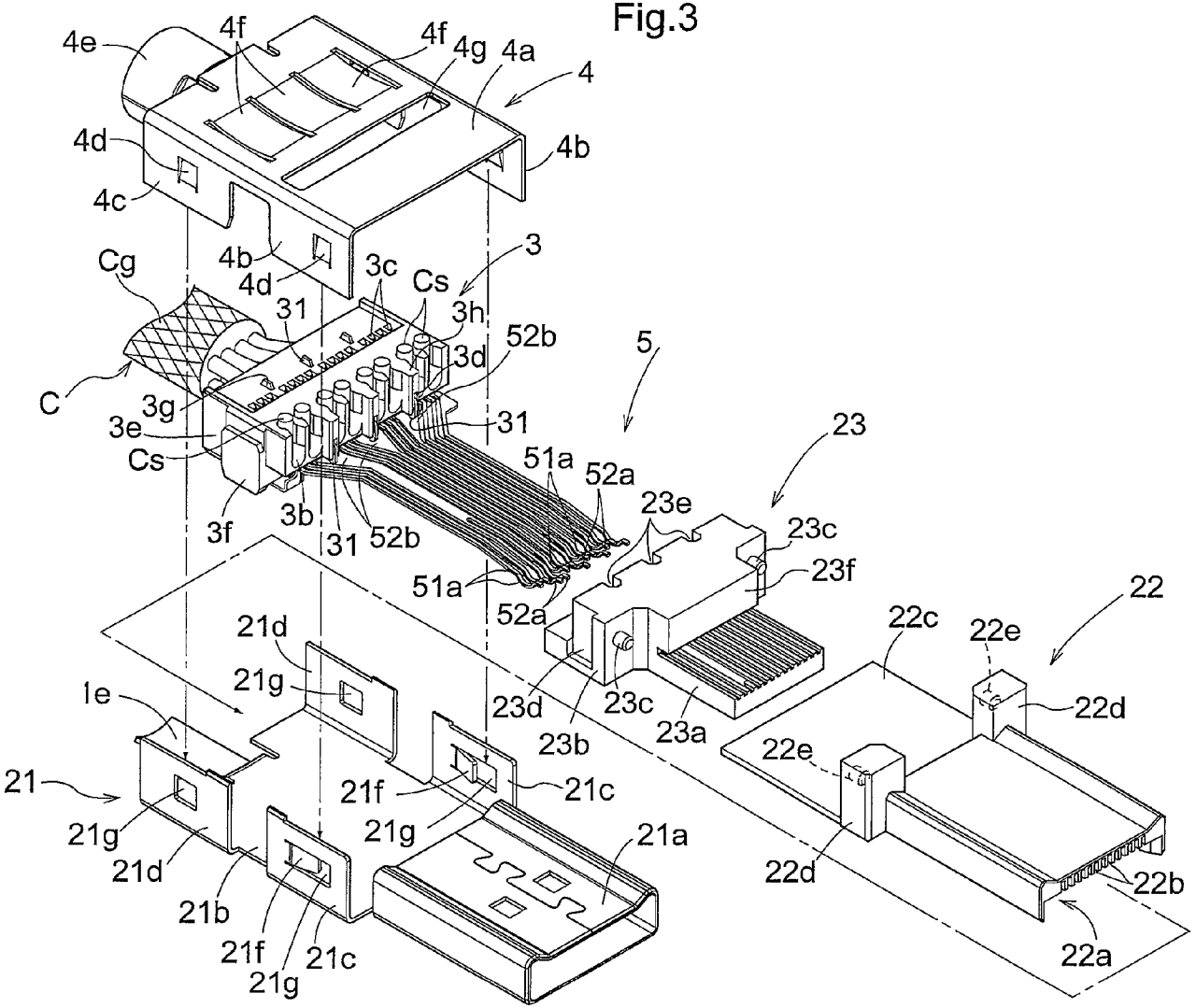
FIG. 3 is a detailed exploded perspective view of the connector according to the present invention.

Next, with reference to the accompanying drawings, an embodiment of the connector according to the present invention will be described. FIG. 1, FIG. 2 and FIG. 3 are a perspective view, an exploded perspective view and a more detailed exploded perspective view showing the connector according to the present invention. As shown in FIG. 1 and FIG. 2, the connector 1 includes a case 1 which is formed of a first case 11 and a second case 12 that are formed of an insulator such as a resin. To one end of the case 1, there is inserted a cable C including a plurality of electric wires sheathed together. Incidentally, in this embodiment, the cable C is provided as a coaxial cable, a plurality of signal wires Cs are sheathed or covered with a conductor such as polyethylene, and the exterior of the conductor is covered with a braided wire acting as a ground wire Cg and this ground wire Cg is covered with an insulator such as vinyl.

Further, from the other end of the case 1, there is extended an inserted portion 21*a* which will be described later. When the inserted portion 21*a* is inserted to a jack of the connection target, the cable C can be connected to the connection target. In the following description, the side where the cable C is inserted will be referred as the "back side" and the side where the inserted portion 21*a* projects will be referred to as the "front side", respectively. Also, in the following description, for the sake of convenience, the first case 11 side will be referred to as the "lower side" and the second case 12 side will be referred to as the "upper side", respectively.

As shown in FIG. 2, in the inner face of the first case 11, four concave portions 11*a* are formed and from the front and back side walls thereof, engaged portions 11*b* each defining an engaging hole 11*c* are formed convexly. In the inner face of the second case 12, there are formed four convex portions 12*a* in correspondence with the concave portions 11*a* of the first case 11. Therefore, when the first case 11 and the second case 12 are fitted to each other, the convex portions 12*a* are engaged in the concave portions 11*a*, whereby the first case 11 and the second case 12 can be fixed in position relative to each other. Further, in the external faces of the front and back side walls of the second case 12, there are formed engaging projections 12*b* in correspondence with the engaging holes 11*c* of the first case 11. Therefore, when the first case 11 and the second case 12 are fitted to each other, the engaging projections 12*b* come into engagement with the respective engaging holes 11*c* of the first case 11, thus preventing easy release of the engagement between the first case 11 and the second case 12.

As shown in FIG. 2 and FIG. 3, inside the case 1, there are accommodated a plug portion 2 having the inserted portion 21*a*, a guide member 3 formed of an insulator for guiding the wires of the cable C to the plug portion 2, and a cover member 4 formed of a conductor such as a metal and configured for covering the plug portion 2 with keeping the inserted portion 21*a* exposed to the outside. The plug portion 2 is accommodated in the case 1, with the inserted portion 21*a* projecting from the front side of the case 1.

As shown in FIG. 3, the plug portion 2 includes a shell 21 formed of a conductor such as a metal, a body 22 formed of an insulator such as a resin, and a contact accommodating member 23 formed of an insulator such as a resin in which a contact 5 to be described later is inserted with its front and back ends extending therefrom and holds this contact 5.

The shell 21 includes the inserted portion 21*a* to be inserted to a jack of the connection target, a bottom wall 21*b* connected to the back of the inserted portion 21*a*, a pair of first side walls 21*c* extending vertically from the opposed sides of the bottom wall 21*b*, a pair of second side walls 21*d* extending vertically from the opposed sides of the bottom wall 21*b* with a predetermined distance from the first side walls 21*c* rearwardly, and a tongue portion 21*e* (an example of "a cover connecting portion" in this invention) extending rearwards from the back end of the bottom wall 21*b*. Further, each first side wall 21*c* includes a pawl portion 21*f* bent inwards therefrom, and the first side walls 21*c* and the second side walls 21*d* respectively form engaging holes 21*g*.

The body 22 includes a contact inserting portion 22*a* which forms a contact inserting groove 22*b* in which the contact 5 is to be inserted and which is inserted in the inserted portion 21*a*, a bottom wall 22*c* connected to the back of the contact inserting portion 22*a*, and a pair of positioning columns 22*d* extending vertically from the front end of the bottom wall 22*c*. And, a concave portion 22*e* is formed in the back wall face of each positioning column 22*d*. When the contact inserting portion 22*a* is to be inserted into the inserted portion 21*a*, the front side walls of the positioning columns 22*d* come into contact with the back end of the inserted portion 21*a*, whereby the body 22 can be fixed in position in the front-back direction.

The contact accommodating member 23 includes a contact supporting portion 23*a* forming a supporting groove for supporting the contact 5, and a contact accommodating portion 23*b* connected to the back of the contact supporting portion 23*a* and accommodating the contact 5 as being inserted therein. The contact 5 is supported by the contact supporting portion 23*a* in such a manner that the front end portion thereof projects more forwardly than the front end portion of the contact supporting portion 23*a*. The back portion of the above-described contact inserting portion 22*a* is formed hollow so as to allow insertion therein of the contact supporting portion 23*a*. When the contact supporting portion 23*a* is inserted in the contact inserting portion 22*a*, the front end portion of the contact 5 projecting beyond the contact supporting portion 23*a* will be inserted into the contact inserting groove 22*b* of the contact inserting portion 22*a*. Incidentally, in the illustration of FIG. 3, the contact 5 and the contact accommodating member 23 are shown separately from each other. As a matter of fact, these are formed integral by the insert molding technique.

Figure 5:
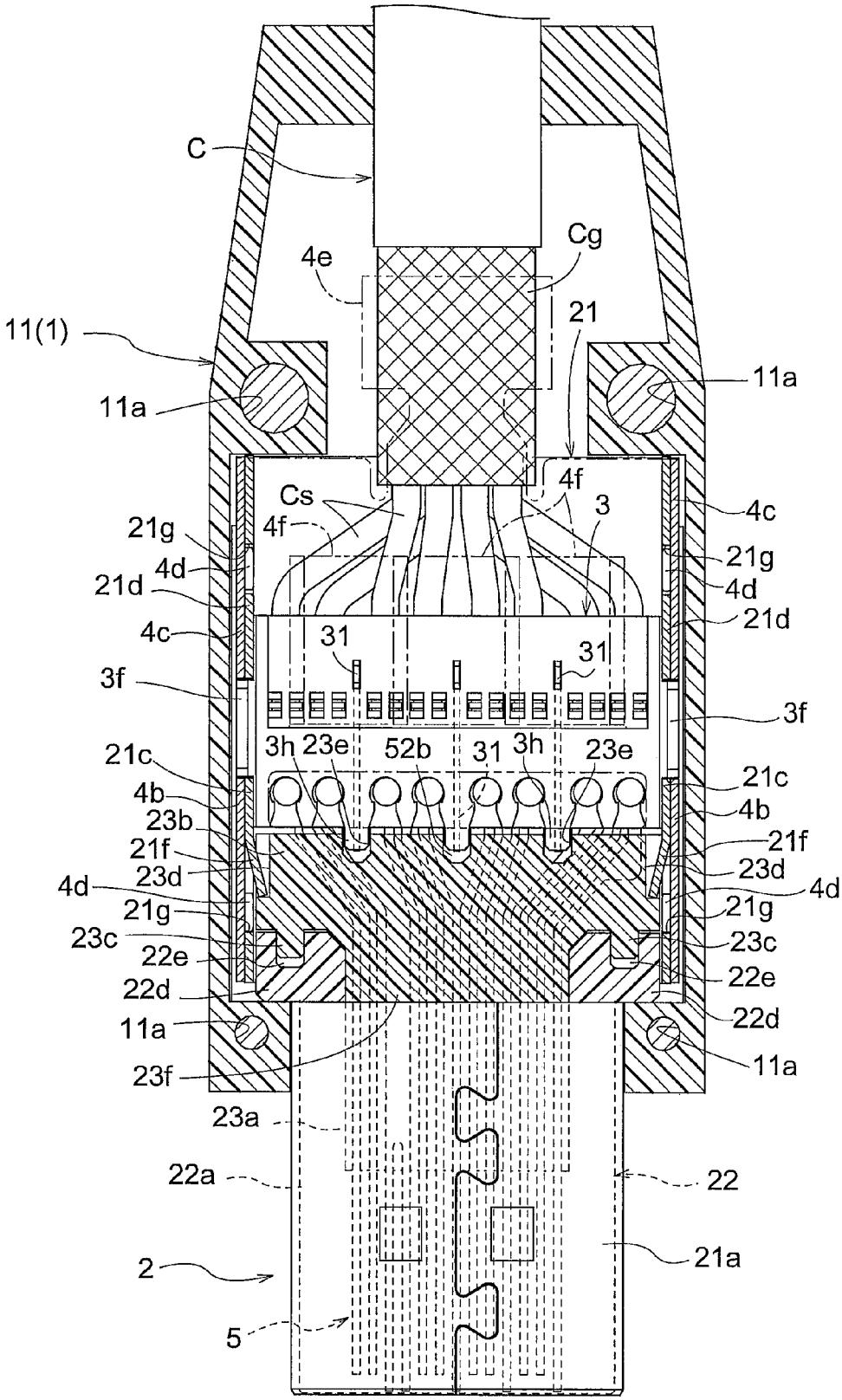
FIG. 5 is a plan view in section showing the connector according to the present invention.

In the front face of the contact accommodating portion 23*b*, there are formed a pair of convex portions 23*c* in correspondence with the concave portions 22*e* of the positioning columns 22*d* of the body 22. When the contact supporting portion 23*a* is inserted in the contact inserting portion 22*a*, the convex portions 23*c* come into engagement in the concave portions 22*e* of the positioning columns 22*d* (see FIG. 5), whereby the contact accommodating member 23 can be fixed in position. Further, between the convex portions 23*c* of the front face of the contact accommodating portion 23*b*, there is formed a projecting portion 23*f* which projects forwardly. In operation, when the contact supporting portion 23*a* is inserted to the contact inserting portion 22*a*, this projecting portion 23*f* will be fitted between the positioning columns 22*d* (see FIG. 5). Further, in the opposed side walls of the contact accommodating portion 23*b*, concave portions 23*d* are formed. In operation, when the contact supporting portion 23*a* is inserted to the contact inserting portion 22*a*, the pawl portions 21*f* of the shell 21 will come into engagement in these concave portions 23*d* (see FIG. 5). With this, inadvertent removal of the contact accommodating member 23 from the body 22 can be prevented. Further, in the back face of the contact accommodating member 23, three engaging grooves 23*e* are formed. Incidentally, the number of these engaging grooves 23*e* corresponds to the number of ground terminals 31 to be described later.

Figure 4:
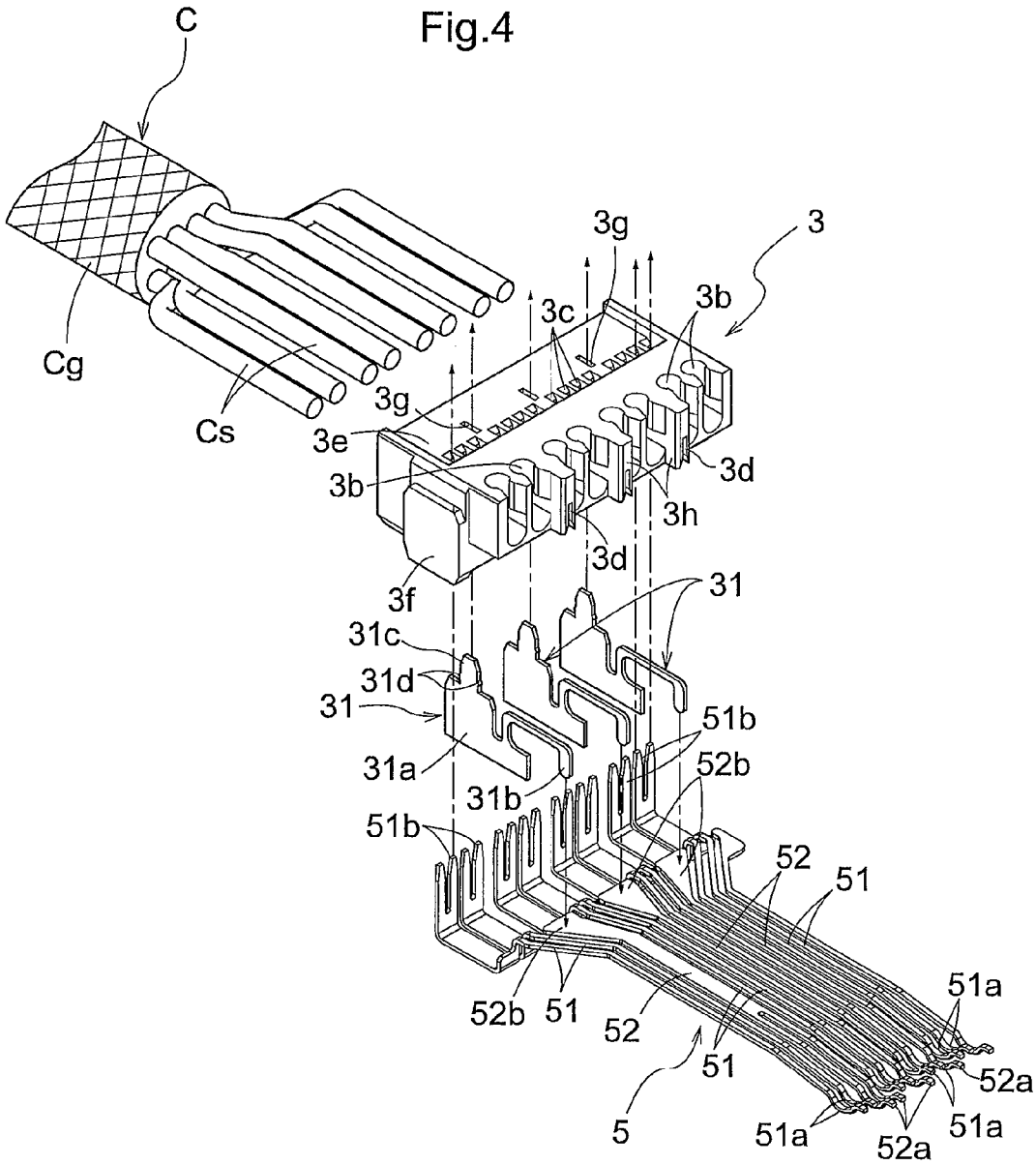
FIG. 4 is a plan view showing layout of the contacts of the connector according to the present invention and connection between the contacts and wires.

FIG. 4 is a perspective view showing the layout of the contact 5 and the relationship between the contact 5 and the guide member 3 and the wires. As shown in FIG. 3 and FIG. 4, the contact 5 in the present invention is comprised of two kinds of contacts, i.e. first contacts 51 and second contacts 52.

At the front end of the first contact 51, there is formed a first movable contact portion 51*a* which is electrically connected to a signal contact of the jack when the connector is inserted to the jack of the connection target. As shown, this first movable contact portion 51*a* has a shape having elasticity, so that the first movable contact portion 51*a* comes into elastic contact with the contact of the jack. With this arrangement, the first movable contact portion 51*a* and the contact of the jack can be elastically contacted to each other in a reliable manner and this contacted condition can be maintained securely as well. On the other hand, at the back end of the first contact 51, there is formed a wire connecting portion 51*b* which is connected to a signal wire Cs of the cable C. The terminal end of the wire connecting portion 51*b* is bent upwards, and its leading end is provided with a U-shape. Hence, in this first contact 51, the width of the wire connecting portion 51*b* is formed greater than the width of the first movable contact portion 51*a*.

On the other hand, at the front end portion of the second contact 52, there is formed a second movable contact portion 52*a* which is electrically connected to a ground contact of the jack in association with insertion of the connector to a jack as the connection target. This second movable contact portion 52*a* of the second contact 52 too, like the first movable contact portion 51*a* of the first contact 51, is provided with a shape having elasticity. Further, at the back end of the second contact 52, there is formed a ground contact portion 52*b* which does not come into direct contact with the wire of the cable C. When the plug portion 2 is viewed from the above, at the engaging groove 23*e* portion of the contact accommodating member 23, the ground contact portion 52*b* of the second contact 52*b* is exposed to the outside (see FIG. 5).

As shown in FIG. 4, the length of the second contact 52 is made shorter than the length of the first contact 51, and the plurality of first contacts 51 and the plurality of second contacts 52 are disposed in juxtaposition with each other. As may be apparent from the illustration, the back end of the second contact 52 is disposed more forwardly than the back end of the first contact 51. More particularly, the back end of the second contact 52 (the back end of the ground contact portion 52*b*) is disposed more forwardly than the front end of the portion of the first contact 51 which portion is formed larger in width than the first movable contact portion 51*a*. Further, the first contact 51 is bent sideway, so that in the space formed by this bending of the first contact 51, the ground contact portion 52*b* of the second contact 52 is disposed. With the above-described arrangements of the first contact 51 and the second contact 52, it is possible to avoid juxtaposition of the wire connecting portion 51*b* of the first contact 51 and the ground contact portion 52*b* of the second contact 52 relative to each other. As a result, the connector can be formed narrower. Further, as shown in FIG. 4, the front end of the first movable contact portion 51*a* of the first contact 51 is retracted from the front end of the second movable contact portion 52*a* of the second contact 52.

Figure 7:
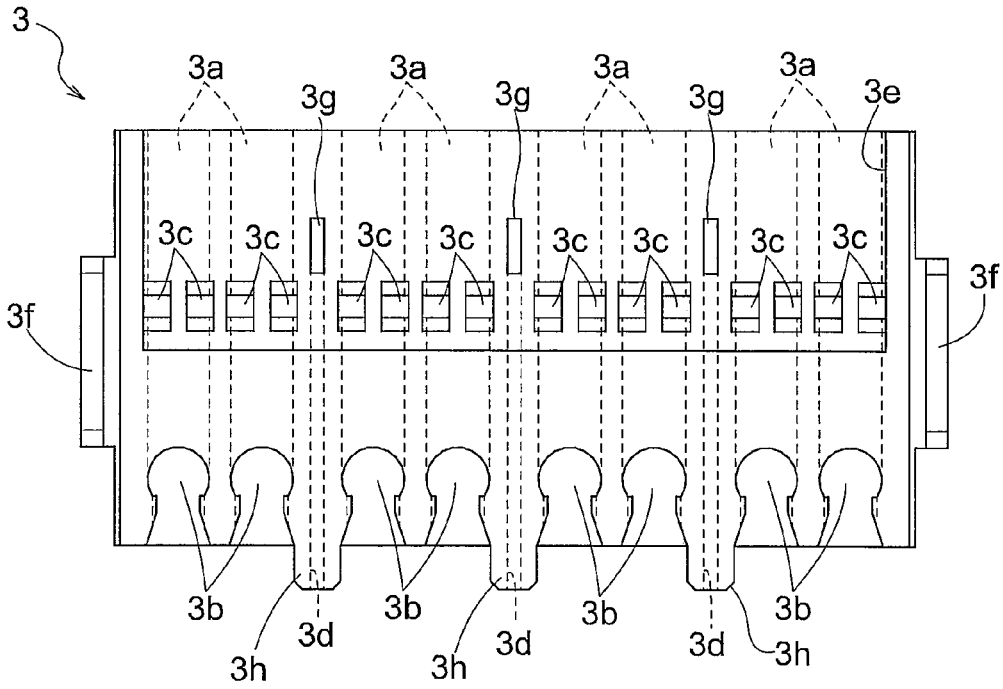
FIG. 7 is a plan view showing a guide member included in the connector according to the present invention.
Figure 8:
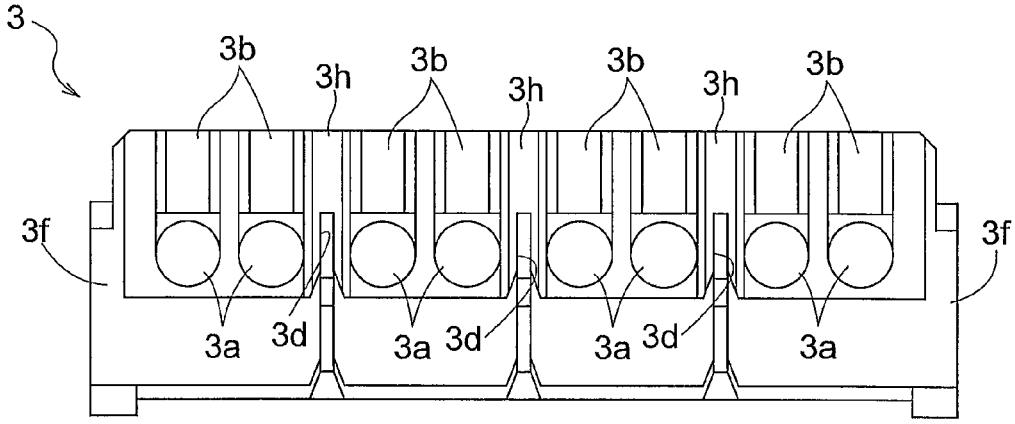
FIG. 8 is a section view showing the guide member of the connector according to the present invention as seen along the front-back direction.

FIG. 7 is a plan view of the guide member 3 and FIG. 8 is a section view of the guide member 3 as seen along the front-back direction. As shown in FIG. 8, the guide member 3 includes wire guide holes 3*a* for allowing insertion of the respective signal wires Cs of the cable C therethrough and guiding them forwardly. Also, as shown in FIG. 7, in the front wall (the lower side in the illustration) of the guide member 3, there are formed guide grooves 3*b* for upwardly guiding the signal wires Cs guided forwardly by the wire guide holes 3*a*. With these arrangements, the respective signal wires Cs are retained by the guide member 3 without contacting each other.

Figure 9:
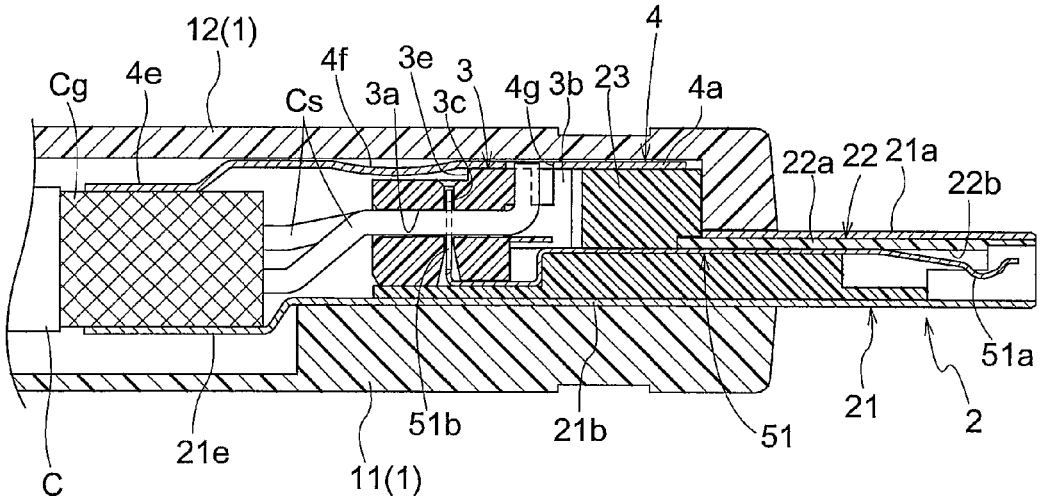
FIG. 9 is a side view in section showing the connector according to the present invention as seen at a position thereof not having a ground terminal.

Further, the guide member 3 forms contact guide holes 3*c* for receiving the U-shaped portions of the wire connecting portions 51*b* of the first contacts 51 when the guide member 3 is attached to the plug portion 2. Each contact guide hole 3*c* is configured to be communicated with each wire guide hole 3*a* corresponding thereto. Therefore, when the guide member 3 is attached to the plug portion 2, the U-shaped portion of the wire connecting portion 51*b* inserted to the contact guide hole 3*c* holds the signal wire Cs through the wire guide hole 3*a* (see FIG. 6). With this, electric connection is established between the signal wire Cs and the wire connecting portion 51*b*. Incidentally, an arrangement is made such that the leading end of the wire connecting portion 51*b* does not project from the contact guide hole 3*c* (see FIG. 9).

The bottom face of the guide member 3 defines ground terminal accommodating grooves 3*d* for accommodating the ground terminals 31. And, the upper face of the guide member 3 defines retaining holes 3*g* communicated to the ground terminal accommodating grooves 3*d*.

As shown in FIG. 4, the ground terminal 31 includes a terminal body 31*a*, a third movable contact portion 31*b* provided with a shape having elasticity and extending forwardly from the terminal body 31*a*, and a projecting portion 31*c* projecting upwards from the body. Then, this ground terminal 31 is inserted from the bottom face of the guide member 3 along the ground terminal accommodating groove 3*d*. In this, the projecting portion 31*c* of the ground terminal 31 is inserted into the retaining hole 3*g* of the guide member 3 and projects from the upper face of the guide member 3. Incidentally, since the projecting portion 31*c* of the ground terminal 31 forms a pair of retaining projections 31*d*, this retaining projection 31*d* will be retained within the retaining hole 3*g* of the guide member 3, thus restricting inadvertent withdrawal of the ground terminal 31 from the ground terminal accommodating groove 3*d*.

Incidentally, the upper face of the guide member 3 forms a recessed portion 3*e*, and the contact guide holes 3*c* and the retaining holes 3*g* are defined in this recessed portion 3*e*.

Further, the front side of the guide member 3 forms engaging projections 3*h* corresponding to the retaining grooves 23*e* of the contact accommodating member 23. The bottom side of this engaging projection 3*h* too defines a ground terminal accommodating groove 3*d* which accommodates the front end of the third movable contact portion 31*b* of the ground terminal 31. Therefore, when the guide member 3 is attached to the plug portion 2, each retaining projection 3*h* of the guide member 3 comes into engagement in the corresponding retaining groove 23*e* of the contact accommodating member 23 and also the third movable contact portion 31*b* of the ground terminal 31 comes into elastic contact with the ground contact portion 52*b* of the second contact 52, whereby the guide member 3 can be fixed in position and the electrical connection can be formed between the second contact 52 and the ground terminal 31, as a result of which the second contact 52 can be grounded. Further, thanks to the elastic contact of the third movable contact portion 31*b* of the ground terminal 31, the ground terminal 31 and the second contact 52 can be placed in secure contact with each other. With this, the assembly work is facilitated and the quality of the connector can be rendered uniform, irrespectively of the skill of the worker. This is important particularly when the connector is to be assembled on a working site.

Figure 6:
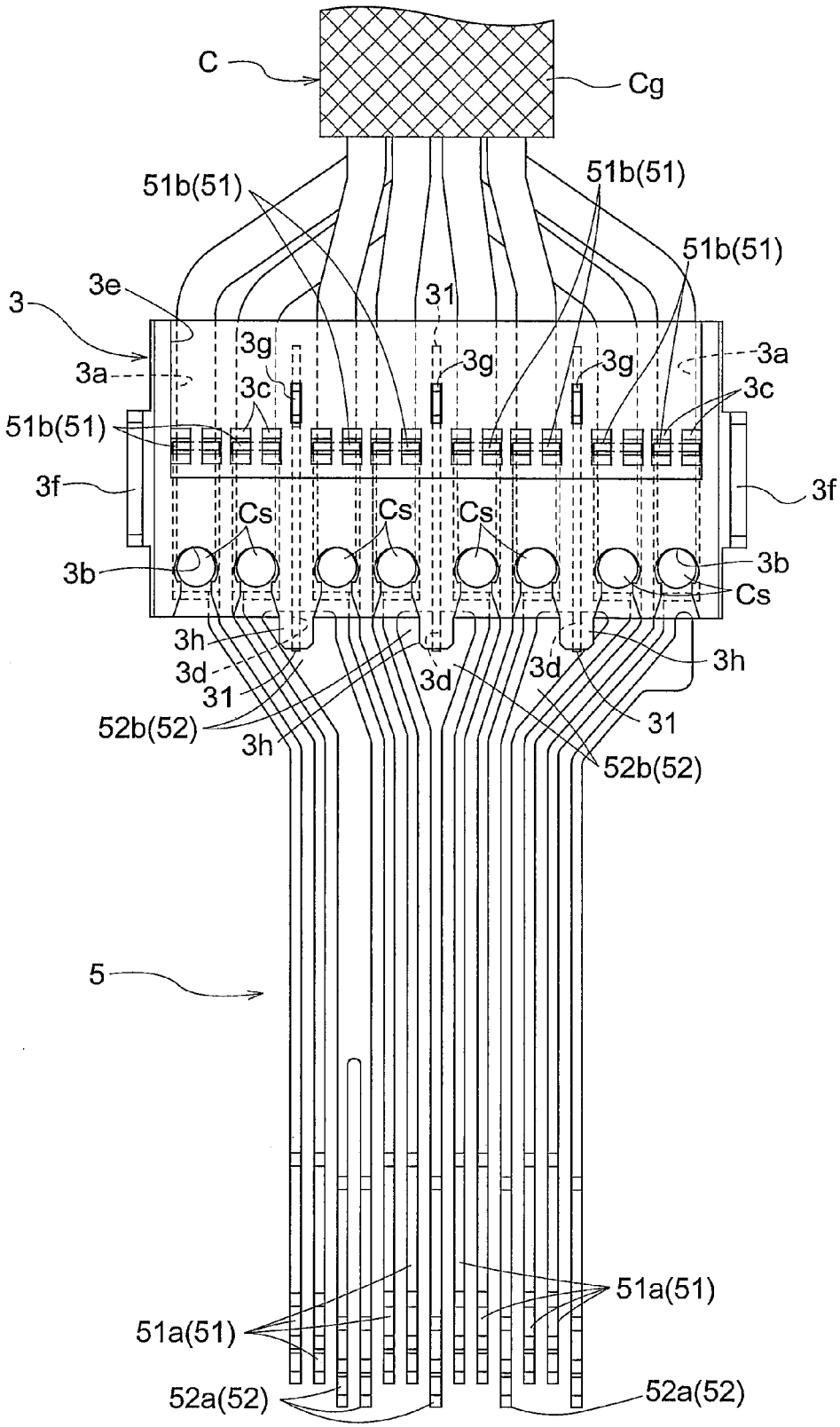
FIG. 6 is a plan view showing layout of the contacts of the connector according to the present invention and connection between the contacts and wires.

Incidentally, the engaging projection 3*h* of the guide member 3 serves to cover the contacting portion between the third movable contact portion 31*b* and the ground contact portion 52*b* (see FIG. 6).

Further, in the lateral walls of the guide member 3, there are formed a pair of projecting portions 3*f* which project laterally. When the guide member 3 is attached to the plug portion 2, each projecting portion 3*f* will be fitted within a gap formed between the first side wall 21*c* and the second side wall 2*d* of the shell 21 of the plug portion 2 (see FIG. 2 and FIG. 5). With this, the guide member 3 can be secured to the plug portion 2.

As shown in FIG. 2 and FIG. 3, the cover member 4 includes an upper wall 4*a*, a pair of first side walls 4*b* extending downward from the opposed ends of the upper wall 4*a*, and a pair of second side walls 4*c* extending downward from the upper wall 4*a* rearwardly of the first side walls 4*b*. The first side walls 4*b* and the second side walls 4*c* include retaining projections 4*d*. When the cover member 4 is attached to the plug portion 2, the retaining projections 4*d* are retained in the retaining holes 21*g* of the first side walls 21*c* and the second side walls 21*d* of the shell 21 (see FIG. 2 and FIG. 5). With this, inadvertent detachment of the cover member 4 from the plug 2 can be prevented.

Further, at the back end of the cover member 4, there is formed a cable holding portion 4*e* (an example of "a ground wire connecting portion" in the present invention) configured to hold the cable C by crimping. In case the cable C includes a ground wire Cg in its outer circumference, as is the case with a coaxial cable, electrical connection is formed between the cover member 4 and the ground wire Cg via this cable holding portion 4*e*. Further, when the cover member 4 is attached to the plug portion 2, the tongue portion 21*e* of the shell 21 of the plug portion 2 comes into contact with the cable holding portion 4*e*. Therefore, when electrical connection is formed between the cover member 4 and the ground wire Cg, the ground wire Cg and the shell 21 can be electrically connected to each other via the cover member 4.

Figure 10:
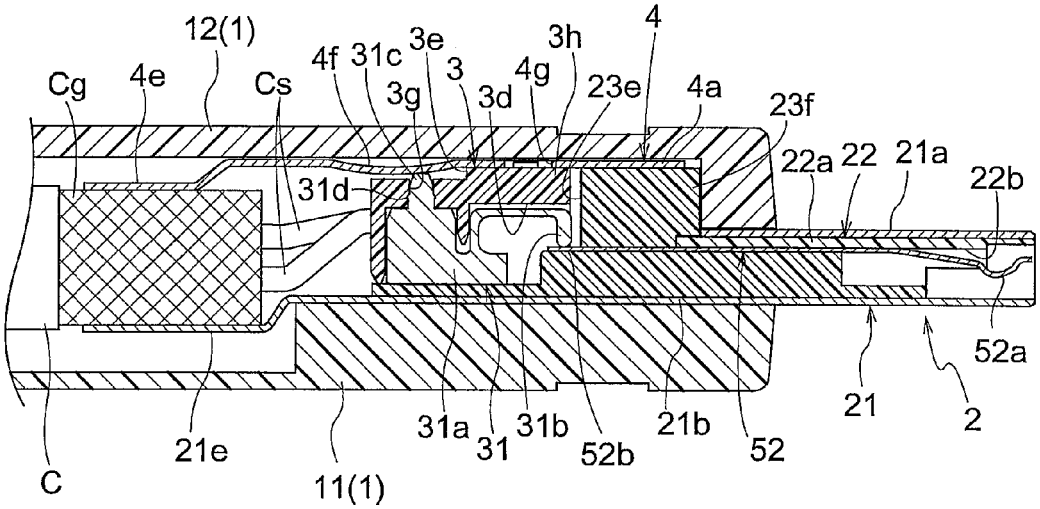
FIG. 10 is a side view in section showing the connector according to the present invention as seen at a position thereof having the ground terminal.

In the upper face of the cover member 4, there is formed a ground terminal connecting portion 4*f* which is bent downwards to obtain elasticity. As shown in FIG. 10, when the cover member 4 is attached to the plug portion 2, this ground terminal connecting portion 4*f* will come into elastic contact with the projecting portion 31*c* of the ground terminal 31 projecting from the upper face of the guide member 3, thus being electrically connected thereto. Therefore, when the cover member 4 is electrically connected to the ground wire Cg, the ground wire Cg and the second contact 52 are electrically connected to each other via the cover member 4 and the ground terminal 31. That is, the ground potential can be provided to the second contact 52.

With the above-described arrangements, the cover member 4, the shell 21 and the second contacts 52 are set with the same potential (ground potential), whereby the EMI performance and the transmission performance of the connector can be improved.

Further, in the upper face of the cover member 4, an opening 4*g* is formed. This opening 4*g* is formed at the position corresponding to the guide grooves 3*b* of the guide member 3 (see FIG. 2).

[Assembly Method]

Next, an assembly method of the inventive connector will be explained. First, the sheath of the cable C is removed to expose the signal wires Cs and the ground wire Cg. Next, each signal wire Cs is inserted into the corresponding wire guide hole 3*a* of the guide member 3 and then bent upwards along the guide groove 3*b*. Then, the guide member 3 is attached to the plug portion 2.

In the course of the above, the wire connecting portion 51*b* of the first contact 51 of the plug portion 2 is inserted to the contact guide hole 3*c* of the guide member 3. The wire connecting portion 51*b* of the first contact 1 inserted in the contact guide hole 3*c* is brought into pressed contact with the signal wire Cs inserted in the wire guide hole 3*a*, whereby electrical connection is established between the signal wire Cs and the first contact 51. Also, the ground terminal 31 accommodated in the guide member 3 is brought into contact with the ground contact portion 52*b* of the second contact 52, thus being electrically connected to each other.

Then, to the plug portion 2 attached to the guide member 3, the cover member 4 is attached and then the cable holding portion 4*e* of the cover member 4 is crimped against the outer periphery of the cable C. With this, electrical connection is established between the ground wire Cg of the cable C and the cover member 4. And, the cover member 4 comes into contact with the ground terminal 31 retained to the guide member 3 via the ground terminal connecting portion 4*f*. With this, electrical connection can be formed between the ground wire Cg and the second contact 52 via the cover member 4 and the ground terminal 31. Further, the tongue portion 21*e* of the shell 21 of the plug portion 2 comes into contact with the cable holding portion 4*e*. With this, electrical connection can be formed between the ground wire Cg and the shell 21 of the plug portion 2 via the cover member 4. Accordingly, the second contact 52, the cover member 4, and the shell 21 of the plug portion 2 are all provided with the same potential (ground potential), whereby the EMI performance and the transmission performance of the connector can be improved.

Lastly, to the plug portion 2 attached with the guide member 3 and the cover member 4, the first case 11 and the second case 12 are attached from the above and from the under, respectively.

As described above, with the connector of the present invention, the connector can be formed compact, while readiness of its assembly and improvement of connector performance can be achieved.

Other Embodiments (1) In the foregoing embodiment, the wire connecting portion 51*b* of the first contact 51 is provided with a U-shape in order to allow connection between the first contact 51 and the signal wire Cs by pressed contact therebetween. However, the invention is not limited thereto. For instance, the first contact 51 and the signal wire Cs can be connected by soldering, for instance. In this case, there is no need to provide the wire connecting portion of the first contact 51 with the U-shape. Instead, the connection portion may be provided in the form of a flat plate or the like.

(2) In the foregoing embodiment, the cable C includes the ground wire Cg on its outer periphery. However, the cable C is not limited thereto. For instance, the signal wires Cs and the ground wire Cg can be provided side by side. In this case too, the cable holding portion 4*e* may be placed in contact with the ground wire Cg. Further, the cable C may omit the ground wire Cg at all. In this case, it is desirable for the cable holding portion 4*e* to be placed in contact with the sheath of the cable C. With this, the ground terminal 31 will be placed in contact with the second contact 52 and the insulator, so that the second contact 52 can be substantially grounded.

The invention claimed is:

1. A connector for connecting a cable having a plurality of wires to a connection target, the connector comprising:

a case formed of an insulator;

a plug portion having an inserted portion to be inserted to a jack of the connection target and accommodated in the case such that the inserted portion projects from the case; and a guide member accommodated in the case and formed of an insulator for guiding the plurality of wires to the plug portion;

wherein the plug portion includes a shell formed of a conductor which forms the inserted portion, a plurality of first contacts, a plurality of second contacts, and a contact accommodating member formed of an insulator;

each of the plurality of first contacts includes a first movable contact portion and a wire connecting portion;

the first movable contact portion is placed into elastic contact with a signal contact of the jack when the inserted portion is inserted to the jack, thereby to establish electric connection with the signal contact;

the wire connecting portion has a greater width than the width of the first movable contact portion and is connected with the wire;

each of the plurality of second contacts has a length shorter than the length of the first contact and includes a second movable contact portion and a ground contact portion;

the second movable contact portion comes into elastic contact with a ground contact of the jack when the inserted portion is inserted into the jack, thus being electrically connected with the ground contact;

the ground contact portion is not directly connected to the wire, the contact accommodating member accommodates the first contacts and the second contacts in juxtaposition with each other in such a manner that the wire-side ends of the second contacts are positioned closer to the inserted portion than the wire connecting portions of the first contacts; and the guide member includes a ground terminal which comes into contact with the ground contact portion of the second contact.

2. A connector according to claim 1, wherein the ground terminal includes a third movable contact portion which comes into elastic contact with the ground contact portion of the second contact.

3. A connector according to claim 1, further comprising:

a cover member formed of a conductor;

wherein the cable includes a ground wire; and the cover member is accommodated in the case and includes a ground wire connecting portion to be electrically connected to the ground wire and a ground terminal connecting portion to be electrically connected to the ground terminal.

4. A connector according to claim 3, wherein the shell includes a cover connecting portion to be connected to the cover member.

* * * * *